US009249608B2

(12) United States Patent
Lang et al.

(10) Patent No.: US 9,249,608 B2
(45) Date of Patent: Feb. 2, 2016

(54) FLUSH DOOR HANDLE WITH SHAPE MEMORY ALLOY DRIVE AND HEATED HANDLE TO BODY SEAL

(71) Applicant: GM GLOBAL TECHNOLOGY OPERATIONS LLC, Detroit, MI (US)

(72) Inventors: Steven C. Lang, Columbus, MI (US); Nilesh D. Mankame, Ann Arbor, MI (US); Hesham A. Ezzat, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/269,648

(22) Filed: May 5, 2014

(65) Prior Publication Data

US 2015/0315826 A1 Nov. 5, 2015

(51) Int. Cl.
*E05B 85/10* (2014.01)

(52) U.S. Cl.
CPC ..... *E05B 85/103* (2013.01); *E05B 85/107* (2013.01)

(58) Field of Classification Search
CPC ..... E05B 85/103; E05B 85/107; E05F 11/20; E05F 11/22; E05F 11/28; E05F 11/30
See application file for complete search history.

(56) References Cited

U.S. PATENT DOCUMENTS

| | | | | |
|---|---|---|---|---|
| 7,108,301 | B2 * | 9/2006 | Louvel | 292/336.3 |
| 7,631,915 | B2 * | 12/2009 | Browne et al. | 296/1.02 |
| 7,905,530 | B2 * | 3/2011 | Browne et al. | 296/1.02 |
| 8,443,553 | B1 * | 5/2013 | Polewarczyk et al. | 49/503 |
| 8,690,204 | B2 * | 4/2014 | Lang et al. | 292/336.3 |
| 8,701,353 | B2 * | 4/2014 | Patel et al. | 49/503 |
| 8,943,752 | B2 * | 2/2015 | Thomas et al. | 49/394 |
| 2006/0273088 | A1 * | 12/2006 | Burkat et al. | 220/212.5 |
| 2013/0076048 | A1 * | 3/2013 | Aerts et al. | 292/336.3 |
| 2013/0127185 | A1 | 5/2013 | Lang et al. | |
| 2013/0170241 | A1 * | 7/2013 | Lesueur et al. | 362/501 |

* cited by examiner

*Primary Examiner* — Katherine Mitchell
*Assistant Examiner* — Catherine A Kelly
(74) *Attorney, Agent, or Firm* — Quinn Law Group, PLLC

(57) ABSTRACT

A door assembly includes a structure including an exterior panel defining an opening, and a grab bar. The grab bar is moveable relative to the exterior panel. A first linkage system and a second linkage system interconnect the grab bar and the structure. A drive assembly is coupled to the first linkage system and the second linkage system to move the grab bar between an extended position and a retracted position. The drive assembly includes a Shape Memory Alloy (SMA) actuator that contracts in response to a control signal, to move the grab bar. A seal may be provided to seal between the grab bar and the structure. A heating element may provide a thermal load to heat the grab bar, a seal surrounding the grab bar, or both.

17 Claims, 3 Drawing Sheets

FLUSH DOOR HANDLE WITH SHAPE MEMORY ALLOY DRIVE AND HEATED HANDLE TO BODY SEAL

TECHNICAL FIELD

The invention generally relates to a deployable door handle for a door assembly of a vehicle.

BACKGROUND

Vehicle doors include an exterior handle, i.e., grab bar, which is mechanically or electrically coupled to a latch mechanism. Actuation of the handle moves the latch mechanism from a latched position to an un-latched position to allow the door to open. The handle may be designed to extend outboard of an exterior surface of an exterior panel of the door assembly to allow an operator to grasp the handle. Alternatively, the exterior surface of the exterior panel may define an inward recess to allow the operator to grasp the handle. Furthermore, vehicle styling may require a flush mounted handle, which includes an outboard surface of the handle that is positioned approximately flush with the exterior surface of the exterior panel of the door assembly when not in use. When needed to open the door, the flush mounted handle deploys out, i.e., moves, relative to the exterior panel of the door assembly, thereby allowing the operator to grasp the handle.

SUMMARY

A door assembly for a vehicle is provided. The door assembly includes a structure having an exterior panel. The exterior panel includes an exterior surface, and defines an opening extending there through. The door assembly includes a grab bar. The grab bar includes an outboard surface, and is moveable relative to the exterior surface of the exterior panel, between a retracted position and an extended position. When the grab bar is disposed in the refracted position, the grab bar is positioned within the opening with the outboard surface of the grab bar approximately flush with the exterior surface of the exterior panel. When the grab bar is disposed in the extended position, the grab bar is laterally spaced outboard of the exterior surface of the exterior panel, thereby allowing a user to grasp the grab bar to position the door assembly in a desired position. A first linkage system interconnects a first longitudinal end of the grab bar and the structure. A second linkage system interconnects a second longitudinal end of the grab bar and the structure. A drive assembly is coupled to the first linkage system and the second linkage system. The drive assembly is operable to move the grab bar between the extended position and the retracted position. The drive assembly includes a Shape Memory Alloy (SMA) actuator that is operable to contract in response to a control signal. Contraction of the SMA actuator moves the first linkage system and the second linkage system simultaneously to move the grab bar from the retracted position into the extended position.

A door assembly for a vehicle is also provided. The door assembly includes a structure. The structure includes an exterior panel having an exterior surface. The exterior panel defines an opening extending through the exterior panel. A grab bar includes an outboard surface, and is moveable relative to the exterior surface of the exterior panel between a retracted position and an extended position. When the grab bar is disposed in the retracted position, the grab bar is positioned within the opening with the outboard surface of the grab bar approximately flush with the exterior surface of the exterior panel. When the grab bar is disposed in the extended position, the grab bar is laterally spaced outboard of the exterior surface of the exterior panel. A seal is attached to one of the structure and the grab bar. The seal is operable to seal between the grab bar and the structure when the grab bar is disposed in the retracted position. A heating element is attached to one of the structure and the grab bar. The heating element is operable to heat at least one of the grab bar, or a portion of the structure surrounding the opening in the exterior panel.

Accordingly, the grab bar moves relative to the exterior panel of the door assembly, between the retracted position in which the outboard surface of the grab bar is approximately flush with the exterior surface of the exterior panel, and the extended position in which the grab bar is spaced from the exterior surface of the exterior panel to allow the operator to grasp the grab bar. The grab bar is moved between the extended position and the retracted position by a lightweight and efficient Shape Memory Ally (SMA) actuator. The seal prevents contaminants from entering an interior space of the door assembly, through the opening in the exterior panel. The heating element prevents the buildup of ice on and/or around the grab bar, which may hinder deployment of the grab bar.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims. Furthermore, the invention may be described herein in terms of functional and/or logical block components and/or various processing steps. It should be realized that such block components may be comprised of any number of hardware, software, and/or firmware components configured to perform the specified functions.

Figure 1:
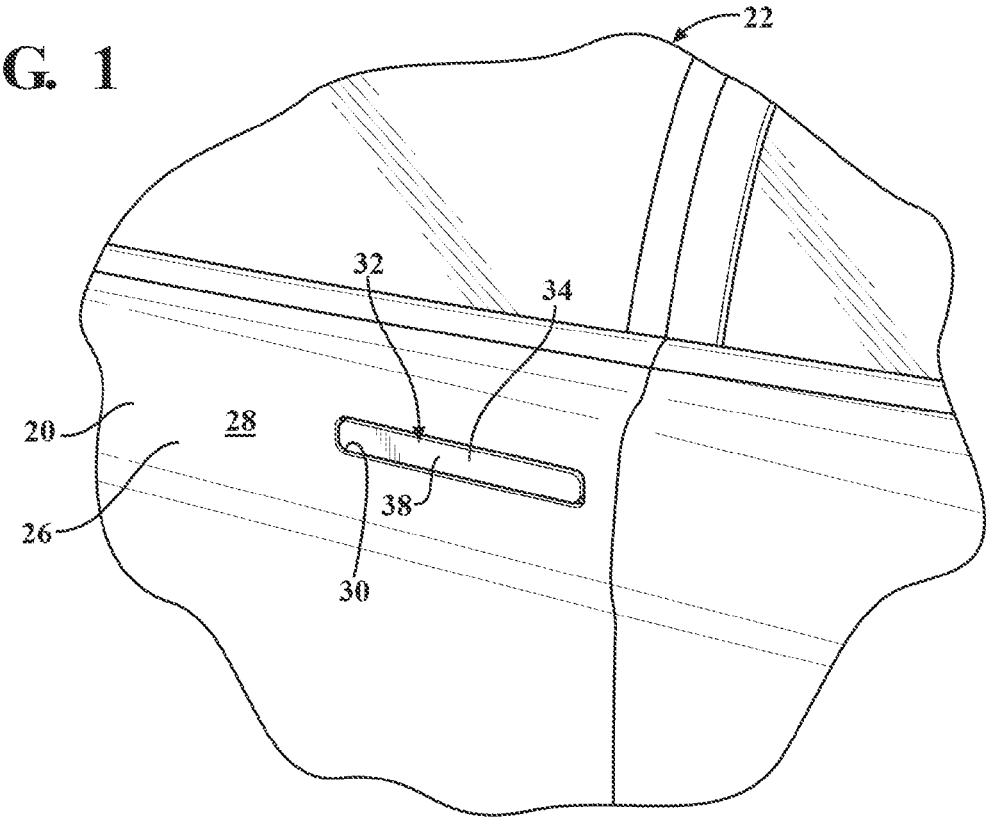
FIG. 1 a schematic perspective view of a door assembly showing a grab bar in a retracted position.
Figure 2:
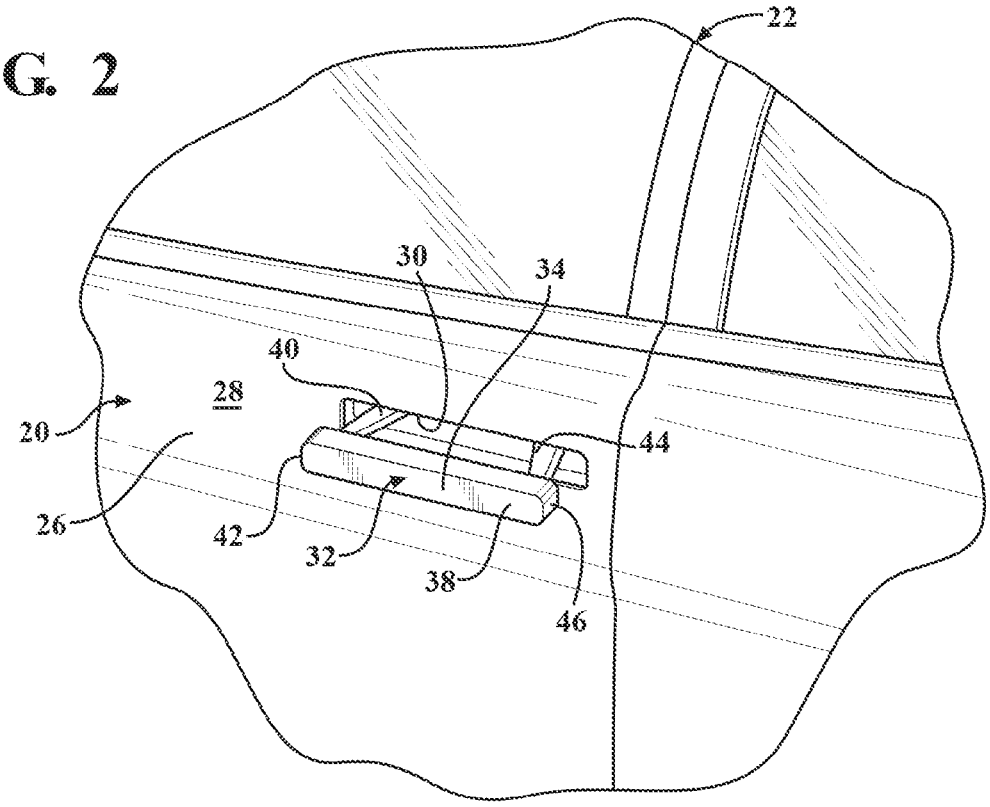
FIG. 2 is a schematic perspective view of the door assembly showing the grab bar in an extended position.

Referring to the Figures, wherein like numerals indicate like parts throughout the several views, a door assembly is generally shown at 20. As shown in FIGS. 1 and 2, the door assembly 20 may be configured for use as a side door of a vehicle 22. Alternatively, the door assembly 20 may be configured for use as a rear cargo door of a vehicle 22, or some other vehicular closure. Furthermore, it should be appreciated that the door assembly 20 may be configured for some other use not associated with a vehicle, such as but not limited to a cabinet door, or some other device that requires a deployable handle.

Figure 3:
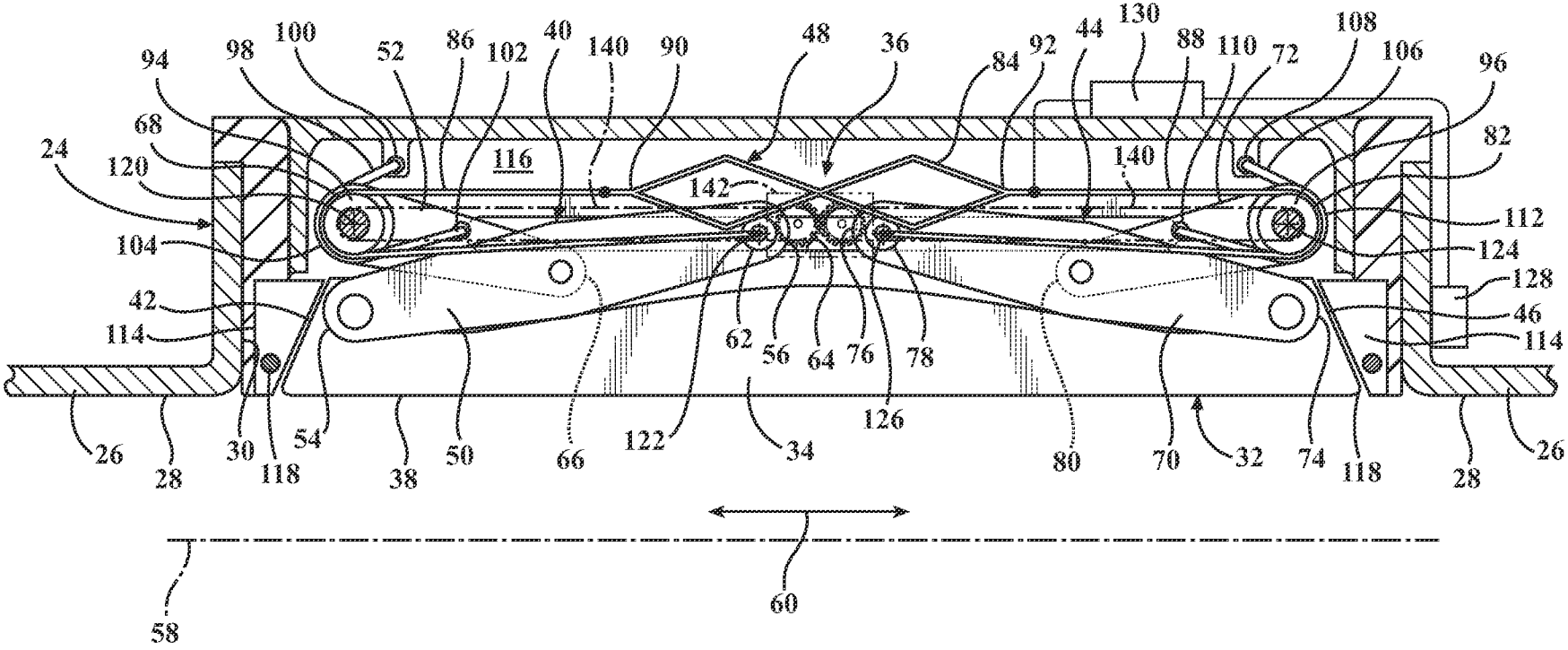
FIG. 3 is a schematic, partially cross sectioned plan view of the door assembly showing the grab bar in the retracted position.
Figure 4:
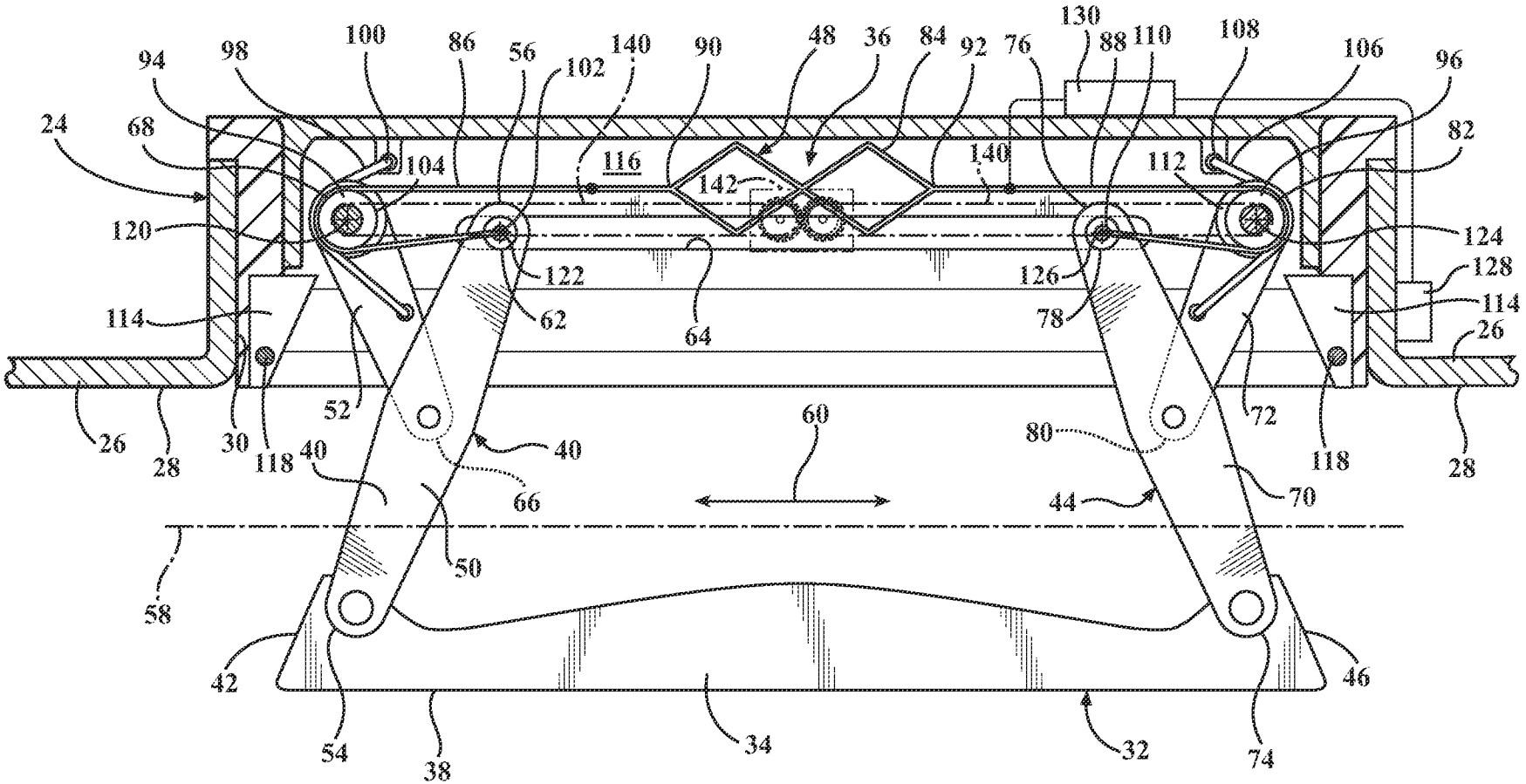
FIG. 4 is a schematic, partially cross sectioned plan view of the door assembly showing the grab bar in the extended position.

Referring to FIGS. 3 and 4, the door assembly 20 includes a structure 24. The structure 24 includes an exterior panel 26 defining an exterior surface 28, and all braces, supports, etc.

necessary to support the exterior panel 26 and the various components of the door assembly 20, and to attach the door assembly 20 to the vehicle 22. The exterior surface 28 is disposed on an outboard side of the exterior panel 26. As used herein, the term "outboard" refers to a location relative to a center of the vehicle 22 that is located farther away from an "inboard" location. As such, an inboard location is disposed nearer the center of the vehicle 22 relative to an outboard location, which is disposed farther from the center of the vehicle 22.

Referring also to FIGS. 1 and 2, the exterior panel 26 defines an opening 30 extending there through. The door assembly 20 further includes a handle assembly 32. The handle assembly 32 is coupled to the structure 24, and includes a grab bar 34 and an actuating system 36 (shown in FIGS. 3 and 4). The grab bar 34 is moveable relative to the exterior surface 28 of the exterior panel 26, between a retracted position, shown in FIGS. 1 and 3, and an extended position, shown in FIGS. 2 and 4. As shown, the grab bar 34 moves in a normal direction relative to the exterior surface 28. However, the grab bar 34 may alternatively be configured to move in a non-normal direction relative to the exterior surface 28. As used herein, the term "normal direction" refers to movement in a direction that is substantially perpendicular to a surface without pivotal and/or rotational movement relative to the surface. It should be appreciated that the exterior surface 28 of the door assembly 20 may include a three dimensional shape that is not perfectly planar. Accordingly, it should be appreciated that the grab bar 34 may move in a direction that is not exactly perpendicular, i.e., not exactly ninety degrees relative to the exterior surface 28. However, as shown in the Figures, the grab bar 34 moves relative to the exterior surface 28 without rotating and/or pivoting relative to the exterior surface 28. Furthermore, it should be appreciated that the movement of the grab bar 34 is normal to the exterior surface 28, regardless of the orientation of the exterior surface 28 relative to a ground surface. Accordingly, the movement of the grab bar 34 relative to the exterior surface 28 may be in a vertical direction relative to the ground, in a horizontal direction relative to the ground, or at any angle therebetween.

The grab bar 34 includes an outboard surface 38, and is positioned within the opening 30 when in the retracted position, with the outboard surface 38 of the grab bar 34 approximately flush with the exterior surface 28 of the exterior panel 26. As used herein, the term "approximately flush" is defined to include surfaces that are substantially disposed on the same plane, but that may include minor feature differences, such as a surface curvature or design accent, that slightly deviate from the shared plane. The grab bar 34 is laterally spaced outboard of the exterior surface 28 of the exterior panel 26 when the grab bar 34 is in the extended position, thereby allowing an operator to grasp the grab bar 34. The grab bar 34 and the opening 30 are sized and shaped to match each other so that the grab bar 34 fits neatly within the opening 30 when in the retracted position, presenting a continuous exterior surface 28 of the door assembly 20. The grab bar 34 and the opening 30 may each include a complimentary shape and/or configuration deemed appropriate to meet the design and styling requirements of the door assembly 20.

Referring to FIGS. 3 and 4, the actuating system 36 is coupled to the grab bar 34, and moveably connects the grab bar 34 to the structure 24 of the door assembly 20. The actuating system 36 is configured for moving the grab bar 34 between the retracted position, shown in FIGS. 1 and 3, and the extended position, shown in FIGS. 2 and 4. The actuating system 36 includes a first linkage system 40 interconnecting a first longitudinal end 42 of the grab bar 34 and the structure 24, and a second linkage system 44 interconnecting a second longitudinal end 46 of the grab bar 34 and the structure 24. The actuating system 36 further includes a drive assembly 48. The drive assembly 48 is coupled to the first linkage system 40 and the second linkage system 44, and is operable to actuate the first linkage system 40 and the second linkage system 44, to move the grab bar 34 between the extended position and the retracted position.

The first linkage system 40 includes a first control arm 50 rotatably coupled to the first longitudinal end 42 of the grab bar 34, and a first swing arm 52 rotatably coupled to the first control arm 50 and the structure 24. The first control arm 50 includes a first end 54 and a second end 56. The first end 54 of the first control arm 50 is rotatably coupled to the first longitudinal end 42 of the grab bar 34. The second end 56 of the first control arm 50 is coupled to the structure 24 for translation or lateral movement in a direction parallel to a longitudinal axis 58 of the grab bar 34, generally indicated by a bi-directional arrow 60. For example, the second end 56 of the first control arm 50 may be coupled to the structure 24 via a first pin 62 that is slideably moveable within a slot 64 defined by the structure 24, with the slot 64 extending substantially parallel with the longitudinal axis 58 of the grab bar 34. While the slot 64 is shown in FIGS. 3 and 4 defining a straight linear path, it should be appreciated that the slot 64 may alternatively be curved to define a curvilinear path. The first swing arm 52 includes a first end 66 and a second end 68. The first end 66 of the first swing arm 52 is rotatably coupled to the first control arm 50, at an approximate midsection of the first control arm 50, between the first end 54 and the second end 56 of the first control arm 50. The second end 68 of the first swing arm 52 is rotatably attached to and positionally fixed relative to the structure 24.

The second linkage system 44 includes a second control arm 70 rotatably coupled to the second longitudinal end 46 of the grab bar 34, and a second swing arm 72 rotatably coupled to the second control arm 70 and the structure 24. The second control arm 70 includes a first end 74 and a second end 76. The first end 74 of the second control arm 70 is rotatably coupled to the second longitudinal end 46 of the grab bar 34. The second end 76 of the second control arm 70 is coupled to the structure 24 for translation or lateral movement in a direction parallel to the longitudinal axis 58 of the grab bar 34, indicated by the bi-directional arrow 60. For example, the second end 76 of the second control arm 70 may be coupled to the structure 24 via a second pin 78 that is slideably moveable within the slot 64 defined by the structure 24. As noted above, the slot 64 extends substantially parallel with the longitudinal axis 58 of the grab bar 34. The second swing arm 72 includes a first end 80 and a second end 82. The first end 80 of the second swing arm 72 is rotatably coupled to the second control arm 70, at an approximate midsection of the second control arm 70, between the first end 74 and the second end 76 of the second control arm 70. The second end 82 of the second swing arm 72 is rotatably attached to and positionally fixed relative to the structure 24.

The drive assembly 48 includes a Shape Memory Alloy (SMA) actuator 84. The SMA actuator 84 is operable to contract in response to a control signal. Contraction of the SMA actuator 84 moves the first linkage system 40 and the second linkage system 44 simultaneously, to move the grab bar 34 from the retracted position into the extended position. Preferably, the control signal includes an applied electrical current. However, as noted below, the control signal for the SMA actuator 84 may include a different form of a control signal.

Suitable shape memory alloys can exhibit a one-way shape memory effect, an intrinsic two-way effect, or an extrinsic two-way shape memory effect depending on the alloy composition and processing history. The two phases that occur in shape memory alloys are often referred to as martensite and austenite phases. The martensite phase is a relatively soft and easily deformable phase of the shape memory alloys, which generally exists at lower temperatures. The austenite phase, the stronger phase of shape memory alloys, occurs at higher temperatures. Shape memory materials formed from shape memory alloy compositions that exhibit one-way shape memory effects do not automatically reform, and depending on the shape memory material design, will likely require an external mechanical force to reform the shape orientation that was previously exhibited. Shape memory materials that exhibit an intrinsic shape memory effect are fabricated from a shape memory alloy composition that will automatically reform themselves.

The temperature at which the shape memory alloy remembers its high temperature form when heated can be adjusted by slight changes in the composition of the alloy and through heat treatment. In nickel-titanium shape memory alloys, for example, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the shape memory material with shape memory effects as well as high damping capacity. The inherent high damping capacity of the shape memory alloys can be used to further increase the energy absorbing properties.

Suitable shape memory alloy materials include without limitation nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like. For example, a nickel-titanium based alloy is commercially available under the trademark NITINOL from Shape Memory Applications, Inc.

The shape memory alloy may be activated, i.e., by the control signal, by any suitable means, preferably a means for subjecting the material to a temperature change above, or below, a transition temperature. For example, for elevated temperatures, heat may be supplied using hot gas (e.g., air), steam, hot liquid, or electrical current. The activation means may, for example, be in the form of heat conduction from a heated element in contact with the shape memory material, heat convection from a heated conduit in proximity to the thermally active shape memory material, a hot air blower or jet, microwave interaction, resistive heating, and the like. In the case of a temperature drop, heat may be extracted by using cold gas, or evaporation of a refrigerant. The activation means may, for example, be in the form of a cool room or enclosure, a cooling probe having a cooled tip, a control signal to a thermoelectric unit, a cold air blower or jet, or means for introducing a refrigerant (such as liquid nitrogen) to at least the vicinity of the shape memory material.

The drive assembly 48 further includes a first cable 86 and a second cable 88. The first cable 86 connects a first end 90 of the SMA actuator 84 and the first linkage system 40. More specifically, the first cable 86 connects the first end 90 of the SMA actuator 84 and the second end 56 of the first control arm 50. The second cable 88 connects a second end 92 of the SMA actuator 84 and the second linkage system 44. More specifically, the second cable 88 connects the second end 92 of the SMA actuator 84 and the second end 76 of the second control arm 70. Contraction of the SMA actuator 84 in response to the control signal slides the second end 56 of the first control arm 50 and the second end 76 of the second control arm 70 in opposite directions along a linear path that is substantially parallel with the longitudinal axis 58 of the grab bar 34, and generally indicated by the bi-directional arrow 60.

Preferably, the first swing arm 52 includes a first guide portion 94. The first guide portion 94 may include a roller or generally cylindrical portion, about which the first cable 86 may be partially wrapped. The first cable 86 is at least partially wrapped around and slideable relative to the first guide portion 94. The second swing arm 72 includes a second guide portion 96. The second guide portion 96 may include a roller or generally cylindrical portion, about which the second cable 88 may be partially wrapped. The second cable 88 is at least partially wrapped around and slideable relative to the second guide portion 96.

The door assembly may further include a timing device 140. The timing device 140 is preferably attached to each of the first guide portion 94 and the second guide portion 96, and is operable to synchronize rotation of the first swing arm 52 and the second swing arm 72 about a first swing axis 120 and a second swing axis 124 respectively. The timing device 140 may include, but is not limited to, a chain or a belt, that is wrapped around both the first guide portion 94 and the second guide portion 96 in a continuous loop, and is engaged in frictional or mechanical engagement with either the first guide portion 94 and the second guide portion 96, or the first swing arm 52 and the second swing arm 72, such that both the first swing arm 52 and the second swing arm 72 rotate simultaneously at the same rotational speed, with the same angular movement. Timing the first swing arm 52 and the second swing arm 72 for simultaneous and equal movement causes the grab bar 34 to move outward in a smooth and parallel fashion, relative to the exterior panel 26. Because the first swing arm 52 and the second swing arm 72 rotate in opposite rotational directions when deploying and storing the gram bar 34, the timing device 140 may require a rotation switching mechanism 142 that maintains synchronization of the timing device 140 relative to the first swing arm 52 and the second swing arm 72, while allowing the first swing arm 52 and the second swing arm 72 to rotate in the appropriate direction. The rotation switching mechanism may include a gear train, pulley system, or some other suitable mechanism.

A first biasing member 98 interconnects the first linkage system 40 and the structure 24. As shown, the first biasing member 98 includes a coil spring having a first end 100 attached to the structure 24, and a second end 102 attached to the first swing arm 52. A coil portion 104 of the first biasing member 98 is wrapped around the first guide portion 94. The first biasing member 98 is operable to bias the grab bar 34 into the retracted position. The first biasing member 98 is operable to elongate the SMA actuator 84, in the absence of the control signal, to move the grab bar 34 from the extended position into the retracted position.

A second biasing member 106 interconnects the second linkage system 44 and the structure 24. As shown, the second biasing member 106 includes a coil spring having a first end 108 attached to the structure 24, and a second end 110 attached to the second swing arm 72. A coil portion 112 of the second biasing member 106 is wrapped around the second guide portion 96. The second biasing member 106 is operable to bias the grab bar 34 into the retracted position. The second biasing member 106 is operable to elongate the SMA actuator 84, in the absence of the control signal, to move the grab bar 34 from the extended position into the retracted position.

Referring to FIGS. 3 and 4, the handle assembly 32 may include a seal 114. The seal 114 is operable to seal 114 between the grab bar 34 and the structure 24, when the grab bar 34 is disposed in the retracted position, to prevent contaminants from entering into an interior 116 of the door assembly 20 through the opening 30 in the exterior panel 26. The seal 114 may be attached to either one of the structure 24 or the grab bar 34. As shown, the seal 114 is attached to the structure 24. The seal 114 may include any suitable material capable of sealing between the structure 24 and the grab bar 34, such as but not limited to, an elastomeric gasket or other similar device.

The handle assembly 32 may further include a heating element 118. The heating element 118 is operable to heat at least one of the grab bar 34 or a portion of the structure 24 surrounding the opening 30 in the exterior panel 26. Preferably, the heating element 118 is a resistance heating element 118 that is capable of generating heat in response to resistance to an electric current. However, it should be appreciated that the heating element 118 may generate heat when signaled in some other manner. Preferably, and as shown in FIGS. 3 and 4, the heating element 118 is attached to the structure 24, and is disposed around a periphery of the opening 30 in the exterior panel 26. Alternatively, the heating element 118 may be attached to or otherwise incorporated into the grab bar 34. For example, the grab bar 34 may be manufactured from and include a thermally conductive material that generates heat in response to a control signal.

As noted above, the SMA actuator 84 is coupled to the first control arm 50 and the second control arm 70 via the first cable 86 and the second cable 88 respectively. Contraction of the SMA actuator 84 slides or translates the second end 56 of the first control arm 50 along the linear path, within the slot 64. The second end 56 of the first control arm 50 is free to translate within the slot 64 in a direction indicated by the bi-directional arrow 60, yet is restrained by the slot 64 against movement in a normal direction relative to the exterior surface 28 of the door assembly 20. Movement of the second end 56 of the first control arm 50 within the slot 64 causes the first swing arm 52 to rotate about a first swing axis 120. Because the first end 66 of the first swing arm 52 is rotatably attached to the middle of the first control arm 50, between the first end 54 and the second end 56 of the first control arm 50, the rotation of the first swing arm 52 about the first swing axis 120 causes the first end 54 of the first control arm 50 to rotate about a first control axis 122. Accordingly, movement of the second end 56 of the first control arm 50 within the slot 64 in a direction parallel with the longitudinal axis 58 of the grab bar 34, approximately parallel with the exterior surface 28 of the door assembly 20, indicated by the bi-directional arrow 60, causes the first swing arm 52 to rotate about the first swing axis 120. Rotation of the first swing arm 52 about the first swing axis 120 causes the rotation of the first control arm 50, about the first control axis 122. In doing so, the first swing arm 52 and the first control arm 50 act in a scissor like motion to move the grab bar 34 in a normal direction toward and away from the exterior surface 28, depending upon which direction the second end 56 of the first control arm 50 is moved within the slot 64.

Similarly, contraction of the SMA actuator 84 slides or translates the second end 76 of the second control arm 70 along the linear path, within the slot 64. The second end 76 of the second control arm 70 is free to translate within the slot 64 in a direction indicated by the bi-directional arrow 60, yet is restrained by the slot 64 against movement in a normal direction relative to the exterior surface 28 of the door assembly 20. Movement of the second end 76 of the second control arm 70 within the slot 64 causes the second swing arm 72 to rotate about a second swing axis 124. Because the first end 80 of the second swing arm 72 is rotatably attached to the middle of the second control arm 70, between the first end 74 and the second end 76 of the second control arm 70, the rotation of the second swing arm 72 causes the first end 74 of the second control arm 70 to rotate about a second control axis 126. Accordingly, movement of the second end 76 of the second control arm 70 within the slot 64 in a direction parallel with the longitudinal axis 58 of the grab bar 34, approximately parallel with the exterior surface 28 of the door assembly 20, indicated by the bi-directional arrow 60, causes the second swing arm 72 to rotate about the second swing axis 124. Rotation of the second swing arm 72 about the second swing axis 124 causes the rotation of the second control arm 70, about the second control axis 126. In doing so, the second swing arm 72 and the second control arm 70 act in a scissor like motion to move the grab bar 34 in a normal direction toward and away from the exterior surface 28, depending upon which direction the second end 76 of the second control arm 70 is moved within the slot 64.

The door assembly 20 may further include a latch mechanism 128. The latch mechanism 128 is coupled to the structure 24 of the door assembly 20, and is moveable between a latched position for securing the door assembly 20 in place relative to the vehicle 22, and an un-latched position for allowing movement of the door assembly 20 relative to the vehicle 22. The latch mechanism 128 may include any suitable style and/or design capable of latching and un-latching the door assembly 20. For example, the latch mechanism 128 may include a latch (not shown) configured to engage a striker (not shown) when in the latched position, and is disengaged from the striker when in the un-latched position.

The door assembly 20 may further include a control module 130. The control module 130 is in communication with the handle assembly 32 and the latch mechanism 128 and may be configured for controlling one or both of the handle assembly 32 and the latch mechanism 128. The control module 130 may include, for example, a computer or other similar device having all necessary software, hardware, algorithms, processor(s), communication links, etc., required to receive and send data and/or control signals to one or both of the handle assembly 32 or the latch mechanism 128. The control module 130 may be linked for communication with the handle assembly 32 and/or the latch mechanism 128 through a hardwired connection or through a wireless system.

The control module 130 is operable to control actuation of the grab bar 34 and actuation of the heating element 118. As such, the control module 130 is operable to initiate and terminate the control signal to the SMA actuator 84 to move the grab bar 34 between the retracted position and the extended position. Furthermore, the control module 130 is operable to apply an electrical current to the heating element 118 to prevent and/or remove any ice accumulation on or around the intersection of the grab bar 34 and the exterior panel 26 that may prevent or hinder the SMA actuator 84 from deploying the grab bar 34.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A door assembly for a vehicle, the door assembly comprising:

a structure including an exterior panel having an exterior surface defining an opening extending through the exterior panel;

a grab bar having an outboard surface, and moveable relative to the exterior surface of the exterior panel between a retracted position and an extended position, wherein the grab bar is positioned within the opening with the outboard surface of the grab bar approximately flush with the exterior surface of the exterior panel when the grab bar is disposed in the retracted position, and wherein the grab bar is laterally spaced outboard of the exterior surface of the exterior panel when the grab bar is disposed in the extended position;

a first linkage system interconnecting a first longitudinal end of the grab bar and the structure;

a second linkage system interconnecting a second longitudinal end of the grab bar and the structure; and a drive assembly coupled to the first linkage system and the second linkage system, and operable to move the grab bar between the extended position and the retracted position, wherein the drive assembly includes:

a Shape Memory Alloy (SMA) actuator operable to contract in response to a control signal, wherein contraction of the SMA actuator moves the first linkage system and the second linkage system simultaneously to move the grab bar from the retracted position into the extended position.

2. The door assembly set forth in claim 1 wherein the drive assembly includes a first cable connecting a first end of the SMA actuator and the first linkage system, and a second cable connecting a second end of the SMA actuator and the second linkage system.

3. The door assembly set forth in claim 2 wherein:

the first linkage system includes a first control arm rotatably coupled to a first longitudinal end of the grab bar, and a first swing arm rotatably coupled to the first control arm and the structure; and the second linkage system includes a second control arm rotatably coupled to a second longitudinal end of the grab bar, and a second swing arm rotatably coupled to the second control arm and the structure.

4. The door assembly as set forth in claim 3 wherein the first cable connects the first end of the SMA actuator and the first control arm, and wherein the second cable connects the second end of the SMA actuator and the second control arm.

5. The door assembly as set forth in claim 4 wherein contraction of the SMA actuator in response to the control signal slides an end of the first control arm and an end of the second control arm in opposite directions along a linear path.

6. The door assembly as set forth in claim 5 wherein the first swing arm includes a first guide portion, with the first cable at least partially wrapped around and slideable relative to the first guide portion, and wherein the second swing arm includes a second guide portion, with the second cable at least partially wrapped around and slideable relative to the second guide portion.

7. The door assembly as set forth in claim 6 further comprising a timing device attached to each of the first guide portion and the second guide portion and operable to synchronize rotation of the first swing arm and the second swing arm about a first swing axis and a second swing axis respectively.

8. The door assembly as set forth in claim 7 wherein the timing device includes a chain or a belt.

9. The door assembly as set forth in claim 1 further comprising a first biasing member interconnecting the first linkage system and the structure, and operable to bias the grab bar into the retracted position, wherein the first biasing member is operable to elongate the SMA actuator in the absence of the control signal to move the grab bar from the extended position into the retracted position.

10. The door assembly as set forth in claim 9 further comprising a second biasing member interconnecting the second linkage system and the structure, and operable to bias the grab bar into the retracted position, wherein the second biasing member is operable to elongate the SMA actuator in the absence of the control signal to move the grab bar from the extended position into the retracted position.

11. The door assembly as set forth in claim 1 wherein the control signal includes an applied electrical current.

12. The door assembly as set forth in claim 1 further comprising a seal operable to seal between the grab bar and the structure, when the grab bar is disposed in the retracted position.

13. The door assembly as set forth in claim 12 wherein the seal is attached to one of the structure or the grab bar.

14. The door assembly as set forth in claim 1 further comprising a heating element operable to heat at least one of the grab bar or a portion of the structure surrounding the opening in the exterior panel.

15. The door assembly as set forth in claim 14 wherein the heating element is a resistance heating element.

16. The door assembly as set forth in claim 14 wherein the heating element is attached to the structure, and is disposed around a periphery of the opening in the exterior panel.

17. The door assembly as set forth in claim 14 further comprising a control module operable to control actuation of the grab bar and actuation of the heating element.

* * * * *